United States Patent [19]

Chung

[11] Patent Number: 4,690,473

[45] Date of Patent: Sep. 1, 1987

[54] ROTARY COUPLING FOR ROTATIVELY CONNECTING A FEEDER LINE TO A ROD ANTENNA

[75] Inventor: Bong-Kwan Chung, Keumsan-kun, Rep. of Korea

[73] Assignee: Sam Sung Electronics Co., Ltd., Suwon Kyungki-do, Rep. of Korea

[21] Appl. No.: 899,410

[22] Filed: Aug. 22, 1986

[30] Foreign Application Priority Data

Aug. 22, 1985 [KR] Rep. of Korea ..... 85-10727[U]

[51] Int. Cl.[4] ..... H01R 39/00

[52] U.S. Cl. ..... 439/1; 439/21; 439/668; 439/669

[58] Field of Search ..... 339/1 R, 1 L, 2, 5–8, 339/41, 177, 14 R, 14 P, 182, 183

[56] References Cited

U.S. PATENT DOCUMENTS 3,686,514 8/1972 Dube et al. ..... 339/5 M
4,003,616 1/1977 Springer ..... 339/8 R

FOREIGN PATENT DOCUMENTS 2507965 9/1976 Fed. Rep. of Germany ..... 339/8 R

*Primary Examiner*—Gil Weidenfeld
*Assistant Examiner*—David Pirlot
*Attorney, Agent, or Firm*—Watson, Cole, Grindle & Watson

[57] ABSTRACT

A rotary coupling for rotatively connecting a feeder line of a television set to a rod antenna includes an antenna body having a pivot terminal rotatably mounted in a fixed terminal holder, and a sleeve on the body rotatably mounted within a fixed sleeve bearing. The body is rotatable about its central axis relative to the holder and the bearing to which the wires of the feeder line are connected, such that any twisting of the feeder line is avoided during such rotation.

4 Claims, 3 Drawing Figures

ROTARY COUPLING FOR ROTATIVELY CONNECTING A FEEDER LINE TO A ROD ANTENNA

TECHNICAL FIELD OF THE INVENTION

This invention relates to an apparatus for connecting a feeder to a rod antenna, and more particularly to a rotary apparatus for connecting a feeder of a television set to a rod antenna on the television set, so as to avoid any twisting of the feeder.

BACKGROUND OF THE INVENTION

FIG. 1 illustrates a prior art arrangement in which a rotatable rod antenna is connected to the feeder by the use of screws. Thus, when adjusting the rod antenna for good television reception, the feeder cannot help being twisted and broken off.

BRIEF SUMMARY OF THE INVENTION

The apparatus according to the invention comprises a pivot terminal, a receptacle, a pivot terminal holder and a sleeve bearing.

It is an object of this invention to provide an apparatus for connecting the feeder to the rod antenna, such that the rod antenna can be freely and easily adjusted for good television reception without twisting or breaking off the feeder during such adjustment.

DETAILED DESCRIPTION OF THE INVENTION

Figure 1:
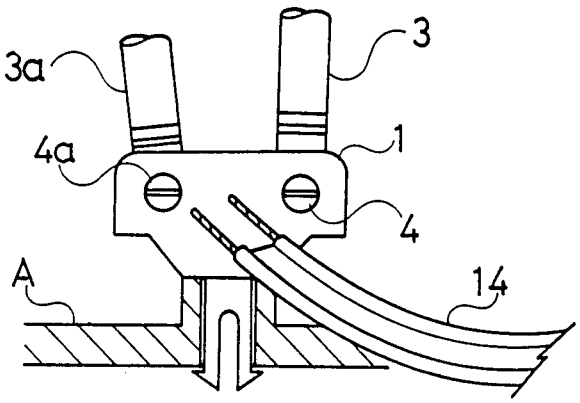
FIG. 1 Prior Art
FIG. 1 is a longitudinal sectional view of the prior art arrangement.
Figure 3:
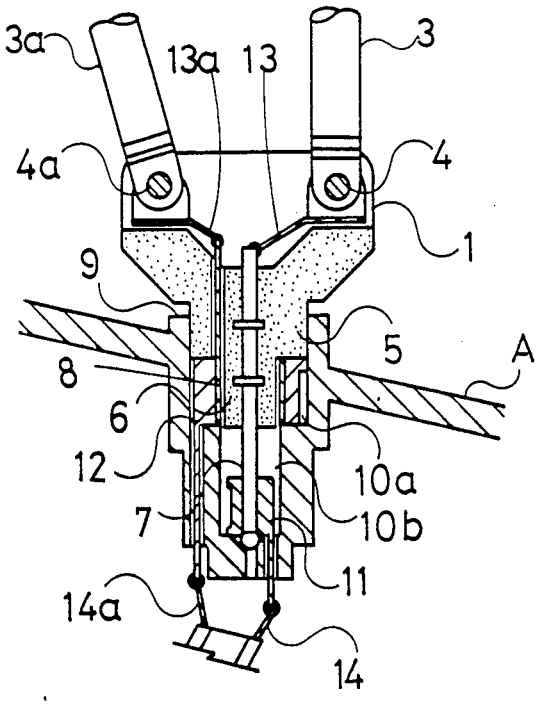
FIG. 3 is a longitudinal sectional view of the invention.
Figure 2:
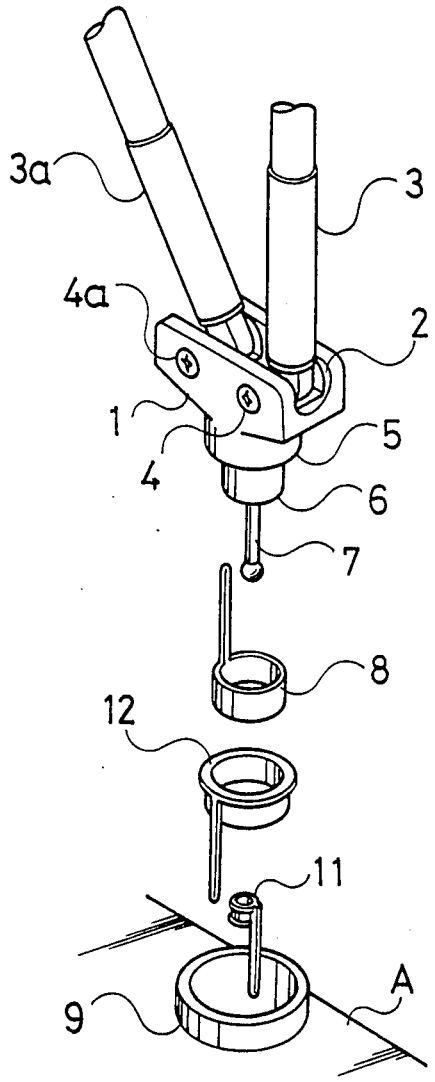
FIG. 2 is an exploded perspective view of the invention.

Referring to FIGS. 1, 2 and 3, a rotatable antenna body 1 has a U-shaped groove 2, a shoulder 5 and a cylindrical plug 6. Rod antennas 3 and 3*a* extend into U-shaped groove 2 of antenna body 1 and are pivotally mounted to the body by screws 4 and 4*a*. As shown in FIGS. 2 and 3, a pivot terminal 7 is embedded in plug 6 of the antenna body 1 at the central axis thereof, and extends through the lower end of the body. A sleeve 8 surrounds the cylindrical plug 6. The sleeve has an upstanding prong extending through a suitable opening in the body, as shown in FIG. 3. Pivot terminal 7 is received within a pivot terminal holder 11, and sleeve 8 is received within a sleeve bearing 12. Television set A has an open receptacle 9 for the reception of plug 5. Sleeve 12 bears against a shoulder formed by a cup-shaped section 10*a* of the receptacle, and holder 11 bears against a shoulder formed by a cup-shaped section 10*b* of the receptacle. The holder has a probe which extends through an opening in the lower wall of receptacle 9, as shown.

A conduction wire 13 is connected with the rod antenna 3, pivot terminal 7, pivot terminal holder 11 and with a line 14 of the antenna feeder. Another conducting wire 13*a* is connected with the rod antenna 3*a*, the probe of sleeve 8, sleeve bearing 12 and with a feeder line 14*a* of the antenna feeder.

When the components are assembled together as aforedescribed, the pivot terminal 7 is rotatably mounted within the pivot terminal holder 11, the sleeve 8 is rotatably mounted within the sleeve bearing 12, and the sleeve bearing has its probe extending through a suitable opening in the receptacle and from the lower end thereof, as shown. Also, the shoulder 5 and the cylindrical plug 6 are received within section 10*a*. The holding portion of pivot terminal holder 11 is received within section 10*b*, and the ball end of the pivot terminal 7 is seated in a ball seat provided in the lower portion of receptacle 9, as shown.

With such an arangement, the rod antennas 3 and 3*a*, the shoulder 5, cylindrical plug 6, the pivot terminal 7 and the sleeve 8 can be easily and freely pivoted about the central axis of terminal 7 when a location of the rod antenna is adjusted for effecting good television reception, although the pivot terminal holder 11 and the sleeve bearing 12 are fixed against rotation by reason of their respective probes extending through the openings in receptacle 9 as aforedescribed. Thus, as compared to the prior art, the antenna feeder line 14 is never twisted or broken off, and can be located with the television set.

What is claimed is:

1. A rotary coupling for rotatively connecting an antenna feeder line of a television set to a rod antenna, a wall of the set having a receptacle open at one end, comprising a rotatable antenna body having a plug received in said receptacle for rotation about its central axis, antenna rods pivotally connectable to said body, a pivot terminal fixed to said body and seated within said receptacle, a sleeve coupled to said body for rotation together therewith, a sleeve bearing in rotary engagement with said sleeve, said bearing being fixed against rotation within said receptacle, a pivot terminal holder in rotary engagement with said terminal and being fixed against rotation within said receptacle, a pair of wires of the feeder line being respectively connectable to said bearing and said holder, and said rods being respectively connectable to said terminal and said sleeve, whereby said body is capable of rotation about said central axis relative to said holder and said bearing for preventing any twisting of the feeder line during such rotation.

2. The coupling according to claim 1, wherein said holder and said bearing have probes extending through openings provided in said receptacle, the wires being connectable to said probes.

3. The coupling according to claim 1, wherein said holder comprises a sleeve through which said terminal extends, said receptacle having a wall at its opposite end, and the free end of said terminal rotatively bearing against said wall.

4. The coupling according to claim 2, wherein said holder comprises a sleeve through which said terminal extends, said receptacle having a wall at its opposite end, and the free end of said terminal rotatively bearing against said wall.

* * * * *